United States Patent [19]

Fuhrmann

[11] Patent Number: 4,508,067

[45] Date of Patent: Apr. 2, 1985

[54] TAPPET AND A CAM CONTACT MEMBER THEREFOR

[75] Inventor: Wolfgang Fuhrmann, Nuremberg, Fed. Rep. of Germany

[73] Assignee: M.A.N. Maschinenfabrik Augsburg-Nürnberg AG, Nuremberg, Fed. Rep. of Germany

[21] Appl. No.: 586,677

[22] Filed: Mar. 6, 1984

[30] Foreign Application Priority Data

Mar. 10, 1983 [DE] Fed. Rep. of Germany ..... 3308550

[51] Int. Cl.[3] ..... F01L 1/14

[52] U.S. Cl. ..... 123/90.49; 123/90.51

[58] Field of Search ..... 123/90.51, 90.48, 90.49; 29/156.7 B

[56] References Cited

U.S. PATENT DOCUMENTS

| | | | |
|---|---|---|---|
| 1,402,226 | 1/1922 | Germonprez | 29/156.7 B |
| 1,496,131 | 6/1924 | Rich | 29/156.7 B |
| 2,983,991 | 5/1961 | Carlson | 123/90.51 |
| 3,301,240 | 1/1967 | Peresada | 123/90.51 |
| 4,279,655 | 7/1981 | Garvie et al. | 106/57 |
| 4,317,433 | 3/1982 | Fuhrmann | 123/90.51 |

FOREIGN PATENT DOCUMENTS

| | | | |
|---|---|---|---|
| 745701 | 12/1943 | Fed. Rep. of Germany | 123/90.51 |

*Primary Examiner*—Ira S. Lazarus
*Assistant Examiner*—R. S. Bailey
*Attorney, Agent, or Firm*—Felfe & Lynch

[57] ABSTRACT

A tappet for cam operation as in an engine valve train has a cavity between a cam-contacting surface and the body of the tappet for allowing the cam-contacting surface to deflect theretoward when contacted by the cam, whereby stresses therein are reduced and the cam-contacting surface can be made from a hard, brittle material.

16 Claims, 2 Drawing Figures

TAPPET AND A CAM CONTACT MEMBER THEREFOR

BACKGROUND OF THE INVENTION

This invention relates to a tappet for cam operation, for example, for a valve-activating arrangement in a reciprocating engine, and especially in an internal combustion engine, and a cam contact member therefor.

A tappet is disclosed in German Patent Specification No. 28 35 912. Its cam-contacting end consists of a circular plate or disc of highly elastic tool steel with both opposite sides of the plate being completely plane. If the actuating cam has a certain width or radius to the edge contacting the plate, the wear-reducing spring deflection of the cam-contacting plate, which is the object of the patented invention, is liable to be lost because the contact between the cam and tappet plate will be substantially linear and thus extend right across to the supporting or fixing edges of the tappet body for holding the plate. Consequently, a higher load cannot arise in the central, plate area of the cam-contacting face of the tappet than the plate-fixing edges of the tappet body can handle without excessive wear.

In addition, there is another drawback to the flat cam-contacting surface disclosed in the patent in that, when there is even a slight error in the alignment of the tappet, in other words, if the centerline of the tappet is not exactly perpendicular to the rotational axis of the camshaft—and this is a matter of a fraction of an angular minute—the plane-faced plate will bear unevenly on the cam. One plate-holding edge of the tappet body may then, again, bear on the cam to limit the wear reduction of the spring action of the plate.

A tappet having a spherical, cam-contacting surface is also known from, for example, German Patent Specification No. 12 09 802. The spherical, cam-contacting surface avoids the problem of uneven engagement with the cam because, if the tappet is misaligned relative to the rotational axis of the cam, the cam will merely engage a portion of the spherical surface adjacent that which it would have engaged with perfect alignment.

If a plane or spherical cam-contacting surface is made from hard, brittle sintered or ceramic-based materials, however, instead of the highly-elastic tool steel disclosed in the first-mentioned patent, for example, the high-frequency (Hertz) stresses that are liable to occur as the cam contacts the surface can dislodge or separate particles of the material. This produces excessive wear which was to be avoided with the use of the hard material. Such wear-producing, high-Hertz stresses are especially likely to occur if the cam-contacting surface is spherical due to the limited, point or line contact of the spherical surface with the cam. The successful use of such hard materials in a spherical cam-contacting surface is, therefore, additionally unexpected as is, still further, any wear-reducing spring-like deflection action from such hard materials.

SUMMARY OF THE INVENTION

This invention, therefore, has for its object improving a tappet in a manner that will reduce cam-caused wear of its cam-contacting surface, avoid the drawbacks described which occur with even slight misalignment of a flat-ended tappet, and allow a hard cam-contacting surface to be used to, ultimately, also help to reduce wear.

To these and other ends, a tappet aspect of the present invention has a generally-spherical, convex cam-contacting surface on one end of the tappet in conjunction with a cavity between the cam-contacting surface of the tappet and the facing end portion of the shank of the tappet which is sufficiently near the cam-contacting surface. As a result, the high-Hertz cam-contact stresses that tend to occur with a spherical cam-contacting surface on the tappet due to the limited contact of the spherical surface with the cam are diminished. This is because the cam-contacting surface of the tappet can, when the cavity is sufficiently near the cam-contacting surface relative to the material thereof, reliably deflect theretoward under the action of the contact force between the cam and the tappet sufficiently to reduce sufficiently the high-Hertz stresses and thus the wear from the cam contact even when the contact surface is made of a hard material. As the tappet cam-contacting surface deflects, the curvature of the spherical surface against which the cam runs is reduced, whereby the local contact pressures, and thus the resulting stresses, are decreased.

This effect is obtained, further, especially at the center of the cam-contacting surface of the tappet where the highest-Hertz stresses exist. Still further, if there is any slight misalignment of the tappet, the spherical tappet will merely contact the cam slightly off-center. Consequently, there is also no possibility of the edge of the tappet bearing damagingly on the cam.

It is of special advantage, in a preferred embodiment, that the diameter of the cam-contacting surface and the thickness from the cam-contacting surface of the tappet to the cavity are dimensioned relative to the material thereof such that the deflection of the cam-contacting surface with the maximum force exerted by the cam is substantially equal to the sphericity of the cam-contacting surface. As a result, the very small line or point cam-contact area obtained with a non-deflecting spherical cam-contacting surface deflects into a quite considerably larger contacting area. Optimally, this extends over the full width of cam contact, i.e., the spherical cam-contacting surface is effectively flat in use.

The reduction in high-Hertz stresses permits the cam-contacting surface of a preferred embodiment of the tappet to be made of a brittle, hard, sintered or ceramic-based material such as titanium carbide, zirconium oxide, aluminum oxide or silicon carbide. Because the local high-Hertz stresses that are liable to occur in the case of spherically-ended, non-deflecting tappets are diminished, separation of wear-promoting particles which would otherwise occur on such hard tappet ends no longer occurs.

In a particularly preferred form of this embodiment, the hard-material, spherical cam-contacting surface of the tappet is on a plate or disc set into one end of the shank or shaft of the tappet body. The cavity is then defined between the preferably-planar side of the plate opposite its spherical, cam-contacting surface and the facing end portion of the tappet shank.

A cam contact member aspect of the invention therefore is a member separate from the body of a tappet but for use on an end of the tappet to provide the cam-contacting surface on the tappet with one or more of the features just described. Specifically, the cam contact member should provide a cavity between the preferably-flat side of the member opposite its generally spherical cam-contacting surface and the facing portion of the tappet for allowing the member to deflect into the cavity, preferably equally to the sphericity of the spherical cam-contacting surface, and may be made of the described hard material.

It should be understood, however, that the cam contacting surface may be a portion of the tappet body itself so long as the cavity is sufficiently close thereto for allowing the described deflection of the surface. For example, the cavity may be a bore longitudinal or transverse of the shank of the tappet with the cam-contacting surface then being an end portion of the tappet body.

DESCRIPTION OF THE DRAWINGS

A preferred embodiment which is intended to illustrate but not to limit the invention will now be described with reference to drawings in which.

DESCRIPTION OF THE PREFERRED EMBODIMENT

Figure 1:
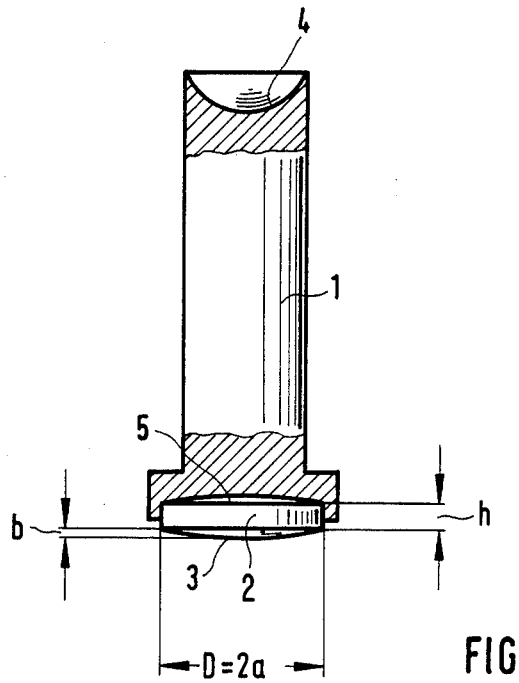
FIG. 1 is an elevation, partly in section, of a tappet having a cam contact member.

FIG. 1 shows a tappet having a solid tappet body or shank 1 made of a cheap material, for instance cast iron, with a cam contact member 2 made of a hard material, for instance zirconium oxide, at one end. The cam contact member 2 is plate or disc shaped and attached about its perimeter to the tappet shank 1 by soldering or glueing, for example, to have an exposed surface 3 for contacting a cam (not shown). Between the side of the cam contact member 2 opposite the side 3 which is contacted by the cam and the facing end portion of the shank 1, there is a cavity 5. It is provided, in this embodiment, by a spherical bottom end on the tappet shank 1 and a flat surface on the cam contact member 2 opposite the cam-engaging surface 3. (The other end of the shank 1 has a force-transmitting surface 4 in the shape of a concave socket which cooperates with other valve-train parts, in particular, a push rod (not illustrated), in the way known for tappet operation).

The cam-contacting surface 3 of the cam contact member 2 is spherical according to an especially-suitable mathematical function given below. As a result, when the cam runs on the cam contact member 2 (or, more exactly, on its cam-contacting surface 3), there is always a reliable deflection of the cam-contacting surface 3 toward the cavity 5. This deflection reduces the high-Hertz stresses, whereby diminished wear is obtained. Furthermore, compensation for slight misalignment of the tappet axis relative to the cam is also obtained.

It is of special advantage to have the diameter D and the thickness h (herein defined as excluding the sphericity, see FIG. 2) of the cam contact member 2 dimensioned so that the resilient deflection of the cam contact member 2 under the maximum force exerted by the cam is just equal to the sphericity b of the cam-contacting face 3 of the cam contact member 2. Although the deflection depends on the physical and geometrical properties of the cam contact member 2, the sphericity b of the cam-contacting surface may be, in general example, between 3 and 10 $\mu$m.

Best results are obtained if the sphericity b of the tappet end is approximated as close as possible to the formula:

$$y = \frac{240 \cdot F \cdot (1 - \mu^2)}{E \cdot h^3} \cdot (a^2 - 0.75\, x^2 - x^2 \ln a/x)$$

The symbols used in this formula have the following meaning:

a is half the diameter D of the cam contact member 2;

h is the thickness of the cam contact member 2;

F is the contact force between the cam-contacting surface 3 of the tappet and the cam (not shown), and usually the maximum contact force prevailing at the nose (maximum radius) of the cam;

E is the Young's modulus of the material of the cam member 2;

$\mu$ is the Poissons's ratio of the material of the cam member 2; and x and y are the Cartesian coordinates of the contour line of a diametric section of the spherical cam-contacting surface 3 defining the sphericity.

Figure 2:
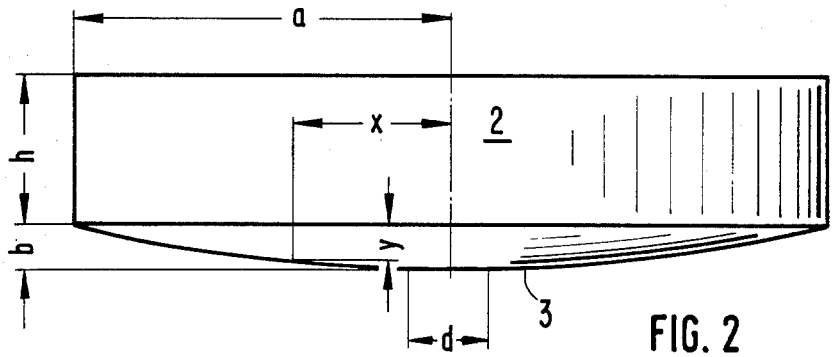
FIG. 2 is an enlarged elevation of the cam contact member shown in FIG. 1.

Also known in FIG. 2 is the diameter d of a generally-circular area. This is defined as the diameter of the flattening (applanation) of the spherical cam-contacting surface 3 of the cam contact member 2 due to the effect of the frequency of the stresses from the action of the force F. In this area, the abovementioned formula is not applicable and the shape of the sphericity is here determined only by criteria of production.

Since the deflection of the tappet-end cam contact member 3, which is firmly clamped into the tappet all round under the action of the maximum contact force, is roughly equal to the sphericity of the non-deflected cam contact member, it is possible to make the tappet end 2 of brittle, hard, sintered or ceramic-based materials, such as titanium carbide, zirconium oxide, aluminum oxide or silicon carbide.

It will be understood that the foregoing specification and examples are illustrative but not limitative of the present invention and that other embodiments within the spirit and scope of the invention will suggest themselves to those skilled in the art.

What is claimed is:

1. A tappet for cam operation, comprising:

a tappet-body shank for tappet operation from one end;

a generally-spherical, convex, cam-contacting surface on the other end of the shank for contacting the cam in the cam operation; and a cavity between the cam-contacting surface and the facing portion of the shank, the cavity being sufficiently close to the cam-contacting surface relative to the material thereof for the cam-contacting surface to be deflected theretoward by each maximum cam-contact force of the cam operation thereon equally to the sphericity of the cam-contacting surface, whereby the wear from the cam contact is reduced.

2. The tappet of claim 1, wherein the sphericity of the generally-spherical cam-contacting surface is given by the formula:

$$y = \frac{240\, F\, (1 - \mu^2)}{E\, h^3} \cdot (a^2 - 0.75\, x^2 - x^2 \ln a/x)$$

the symbols used in this formula having the following meaning:

a is half the diameter D of the cam contact surface;

h is the thickness from the cam-contacting surface to the cavity;

F is the maximum contact force between the cam-contacting surface and cam;

E is the Young's module of the material of the cam-contacting surface;

$\mu$ is the Poissons's ratio of the material of the cam-contacting surface; and x and y are the Cartesian coordinates of the contour line of a diametric section of the cam-contacting surface defining the sphericity.

3. The tappet of claim 2, and additionally comprising: a plate-shaped cam contact member on the other end of the shank having the cam-contacting surface thereon.

4. The tappet of claim 3, wherein the cam contact member is made from one of a sintered and ceramic-based brittle, hard material.

5. The tappet of claim 4, wherein the material is selected from the group consisting of titanium carbide, zirconium oxide, aluminum oxide, and silicon carbide.

6. The tappet of claim 2, wherein the cam-contacting surface is made from one of a sintered and ceramic-based brittle, hard material.

7. The tappet of claim 1, and additionally comprising: a plate-shaped cam contact member on the other end of the shank having the cam-contacting surface thereon.

8. The tappet of claim 7, wherein the cam contact member is made from one of a sintered and ceramic-based brittle, hard material.

9. The tappet of claim 1, wherein the cam-contacting surface is made from one of a sintered and ceramic-based brittle, hard material.

10. The tappet of claim 9, wherein the material is selected from the group consisting of titanium carbide, zirconium oxide, aluminum oxide, and silicon carbide.

11. A cam contact member for a tappet for cam operation, comprising:

a plate-shaped member having a generally-spherical cam-contacting surface on one side and configured for placement on one end of the tappet with a cavity between the side of the cam contact member opposite the cam-contacting surface and the facing end portion of the tappet, the plate-shaped member having a diameter and thickness relative to its material such that each deflection of the cam-contacting surface under the maximum force of cam operation thereon equals the sphericity of the cam-contacting surface.

12. The cam contact member of claim 11, wherein the side of the member opposite the cam-contacting surface is planar.

13. The cam contact member of claim 11, wherein the member is made of one of a sintered and ceramic-based hard, brittle material.

14. The cam contact member of claim 11, wherein the material is selected from the group consisting of titanium carbide, zirconium oxide, aluminum oxide, and silicon carbide.

15. A cam contact member for use on a tappet having a cavity on one end, comprising:

a plate-shaped member having a generally-spherical surface on one side for contacting a cam and a planar opposite side for defining a cavity when the cam contact member is placed over the cavity on the one end of the tappet, the member being made from one of a sintered and ceramic-based hard, brittle material and having a diameter and thickness relative to its material such that each deflection of the cam-contacting surface under the maximum force of cam operation thereon equals the sphericity of the cam-contacting surface.

16. The cam contact member of claim 15, wherein the material is selected from the group consisting of titanium carbide, zirconium oxide, aluminum oxide, and silicon carbide.

* * * * *